US011066729B2

(12) United States Patent
Lee

(10) Patent No.: US 11,066,729 B2
(45) Date of Patent: Jul. 20, 2021

(54) HIGH-ELASTICITY ALUMINUM ALLOY AND METHOD OF MANUFACTURING THE SAME

(71) Applicants: Hyundai Motor Company, Seoul (KR); Kia Motors Corporation, Seoul (KR)

(72) Inventor: Kyung Moon Lee, Gyeonggi-Do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 132 days.

(21) Appl. No.: 16/509,092

(22) Filed: Jul. 11, 2019

(65) Prior Publication Data

US 2019/0338400 A1 Nov. 7, 2019

Related U.S. Application Data

(62) Division of application No. 14/510,512, filed on Oct. 9, 2014, now Pat. No. 10,392,681.

(30) Foreign Application Priority Data

May 2, 2014 (KR) ..... 10-2014-0053361

(51) Int. Cl.
*C22C 21/02* (2006.01)
*C22C 1/02* (2006.01)
(Continued)

(52) U.S. Cl.
CPC ..... *C22C 21/02* (2013.01); *B22D 21/007* (2013.01); *C22C 1/02* (2013.01); *C22C 1/026* (2013.01);
(Continued)

(58) Field of Classification Search
None
See application file for complete search history.

(56) References Cited

U.S. PATENT DOCUMENTS

2004/0011515 A1 1/2004 Matsushima
2010/0200454 A1 8/2010 Goglio

FOREIGN PATENT DOCUMENTS

CN 103192064 A 7/2013
JP H10204555 A 8/1998
(Continued)

OTHER PUBLICATIONS

English language machine translation of KR101845414B1 to Lee, equivalent to KR 20140021396 A to Lee. Generated Jan. 14, 2020. (Year: 2020).*

(Continued)

*Primary Examiner* — Brian D Walck
(74) *Attorney, Agent, or Firm* — Mintz Levin Cohn Ferris Glovsky and Popeo, P.C.; Peter F. Corless

(57) ABSTRACT

Disclosed is a high-elasticity aluminum alloy which contains carbide to improve elongation. Further, a method of manufacturing the high-elasticity aluminum alloy is provided. The method includes steps of: charging pure aluminum and an Al-5B master alloy in a melting furnace to form a first molten metal; charging an Al-10Ti master alloy in the first molten metal to form a second molten metal; charging silicon (Si) element in the second molten metal to form a third molten metal; adding carbon (C) to the third molten metal to form a fourth molten metal; and tapping the fourth molten metal into a mold to cast the fourth molten metal.

1 Claim, 11 Drawing Sheets

(51) Int. Cl.

| | |
|---|---|
| ***C22C 21/00*** | (2006.01) |
| ***C22C 21/04*** | (2006.01) |
| ***B22D 21/00*** | (2006.01) |
| ***C22C 32/00*** | (2006.01) |

(52) U.S. Cl.
CPC ..... *C22C 21/00* (2013.01); *C22C 21/003* (2013.01); *C22C 21/04* (2013.01); *C22C 32/0052* (2013.01); *C22C 32/0063* (2013.01)

(56) References Cited

FOREIGN PATENT DOCUMENTS

| | | | |
|---|---|---|---|
| JP | 11-336899 | A | 12/1999 |
| JP | 2000-080430 | A | 3/2000 |
| JP | 2001342577 | A | 12/2001 |
| KR | 10-2008-0064984 | A | 7/2008 |
| KR | 10-2013-0058997 | A | 6/2013 |
| KR | 10-1316068 | B1 | 10/2013 |
| KR | 10-2014-0021396 | A | 2/2014 |

OTHER PUBLICATIONS

Lyle et al., "Aluminum Alloys", Ullmann's Encyclopedia of Industrial Chemistry, Available online Jun. 15, 2000.

* cited by examiner

HIGH-ELASTICITY ALUMINUM ALLOY AND METHOD OF MANUFACTURING THE SAME

CROSS REFERENCE TO RELATED APPLICATION

The present application is a Divisional of U.S. application Ser. No. 14/510,512, filed on Oct. 9, 2014, which claims priority of Korean Patent Application Number 10-2014-0053361 filed on May 2, 2014, the entire contents of which application are incorporated herein for all purposes by this reference.

TECHNICAL FIELD

The present invention relates to a high-elasticity aluminum alloy and a method of manufacturing the same. More particularly, the high-elasticity aluminum alloy may contain carbide to improve elongation.

BACKGROUND

Recently, s regulations for environment and fuel efficiency have been stricter, the desires for reducing a vehicle weight has increased. As such a light-weight metal alloy, such as an aluminum alloy, has been increasingly applied to vehicles.

Generally vehicle parts using a conventional aluminum alloy have been developed on the basis of a process of stabilizing high strength and product quality, and the process mostly has been developed for improvement in tensile strength which is a material property index at the time of rupture. However, the durability and noise vibration harshness (NVH) the conventional alloy may deteriorate due to the weight reduction thereof.

Accordingly, a development of a high-elasticity aluminum alloy for improving the durability and NVH of a vehicle is in an urgent need. For example, research for improving the elastic modulus of the aluminum alloy using boride has been conducted.

Boride typically refers to a compound of boron (B) with an element having electronegativity lower than that of boron (B). Examples of boride may include $TiB_2$ and $AlB_2$, each of which is formed of boron (B) with aluminum (Al) or titanium (Ti). The boride may be added to a molten aluminum alloy.

For example, in the related art, an aluminum cast material has been developed. The aluminum cast material may be composed of an aluminum master alloy including: silicon in an amount of about 8.0 to 11.5 wt %, manganese, magnesium, iron, copper, zinc, molybdenum, zirconium strontium, sodium, calcium, gallium phosphide or indium phosphide; titanium in an amount of about 1 to 2 wt %; and boron in an amount of about 1 to 2 wt %. Further, an aluminum cast material including 12~15 wt % of silicon and 0.1 wt % or less of titanium in the form of $TiB_2$ has also been reported in the related art.

In order to improve the strength and NVH of a vehicle, a high-elasticity aluminum alloy which is obtained by the addition of Ti or B to a conventional aluminum alloy has been developed. When Ti or B is added to the conventional aluminum alloy, $TiB_2$, $AlB_2$ or $Al_3Ti$ as of reinforcing particles are formed, thus increasing the elastic modulus of the aluminum alloy from about 78 GPa (based on ADC 12) to about 90 GPa. In this case, the strength and NVH of the aluminum alloy may be improved by the addition of Ti or B.

However the elongation of such aluminum alloy may be reduced due to needle-shaped $Al_3Ti$ reinforcing particles.

The description provided above as a related art of the present invention is just merely for helping understanding the background of the present invention and should not be construed as being included in the related art known by those skilled in the art.

SUMMARY OF THE INVENTION

Accordingly, than a preferred aspect, theThe present invention has been devised to can provide provides technical solutions to solve the above-mentioned problems, and an object of the present invention is to. Accordingly, provide a high-elasticity aluminum alloy is provided. Particularly, the elongation thereof of the high-elasticity aluminum alloy is may be improved and while the strength thereof of the high-elasticity aluminum alloy is maintained by the addition of Ti and B.

In order to accomplish the above object, anon aspect of the present invention, provides a high-elasticity aluminum alloy, including may include: titanium (Ti); and boron (B), wherein In particular, the aluminum alloy includes may include carbide in the alloy internal tissue or alloy composition body or compositional network thereof, and the content of carbon in the carbide is may be in an amount of about 0.3~to 0.5 wt %. In certain exemplary embodiments, the carbide may be TiC or SiC.

In an exemplary embodiment, the aluminum alloy may include: titanium (Ti) in an amount of about 4 to 6 wt %; boron (B) in an amount of about 0.5 to 1.5 wt %; silicon (Si) in an amount of about 10 to 12 w %; a balance of aluminum; and inevitable impurities.

It is understood that weight percents (wt %) of alloy composition as disclosed herein are based on total weight of the alloy, unless otherwise indicated.

The present invention also provides the aluminum alloy consists essentially of: titanium (Ti) in an amount of about 4 to 6 wt %; boron (B) in an amount of about 0.5 to 1.5 wt %; silicon (Si) in an amount of about 10 to 12 w %; carbon in an amount of about 0.3 to about 0.5 wt %; a balance of aluminum; and inevitable impurities.

In another aspect, a method of manufacturing a high-elasticity aluminum alloy is provided. In an exemplary embodiment, the method may include steps of: charging pure aluminum and an Al-5B master alloy in a melting furnace to form a first molten metal; charging an Al-10Ti master alloy in the first molten metal to form a second molten metal; charging silicon (Si) element in the second molten metal to form a third molten metal; adding carbon (C) to the third molten metal to form a fourth molten metal; and tapping the fourth molten metal into a mold to cast the fourth molten metal. In particular, in the step of forming the fourth molten metal, the carbon (C) may be added in an amount of about 0.3 to 0.5 wt %.

Other aspect or embodiments of the present invention are disclosed infra.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprise", "include", "have", etc. when used in this specification, specify the presence of stated features, integers, steps, operations, elements, components, and/or combinations of them but do not preclude the presence or addition of one or more other features, integers, steps, operations, elements, components, and/or combinations thereof.

Unless otherwise defined, all terms including technical and scientific terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereinafter, various exemplary embodiments of the present invention will be described in detail with reference to the attached drawings.

As used herein, $TiB_2$, $Al_3Ti$ or $AlB_2$ may be formed as reinforcing particles by adding Ti or B to an aluminum cast alloy, such as ADC12 alloy. The aluminum cast alloy including $TiB_2$ particles are advantageous for high-pressure casting; the casting aluminum alloy including $Al_3Ti$ particles are generally used in power train parts; and the casting aluminum alloy including $AlB_2$ particles have thermodynamic priority orders.

Although $Al_3Ti$ and $AlB_2$ reinforcing particles have moderate thermodynamic stability, $TiB_2$ reinforcing particles may be most thermodynamically stable. For example, when 5Ti is added to an aluminum alloy, $Al_3Ti$ reinforcing particles are produced in large amounts, and thus may improve the elasticity of the aluminum alloy. However, the elongation of the aluminum alloy may decrease because the $Al_3Ti$ reinforcing particles are needle-shaped particles.

Figure 1:
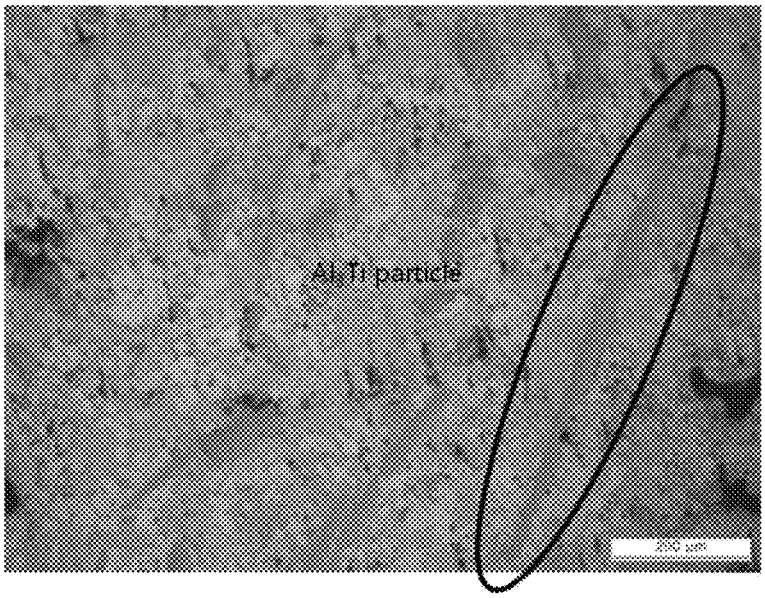
PRIOR ART FIG. 1
FIG. 1 is a photographic view showing $Al_3Ti$ particles formed in an exemplary conventional high-elasticity aluminum alloy.

FIG. 1 is a photographic view showing $Al_3Ti$ particles formed in an exemplary conventional ADC12-5Ti-1B alloy. As shown in FIG. 1, $Al_3Ti$ particles are coarse and needle-shaped. Therefore, this ADC12-5Ti-1B alloy may have less elongation than the conventional aluminum cast alloy, ADC12 alloy. Therefore, in order to improve the elongation in the ADC12-5Ti-1B alloy, the formation of $Al_3Ti$ particles may be minimized and strength of the ADC12-5Ti-1B alloy may be improved by the addition of carbon (C).

Figure 2A:
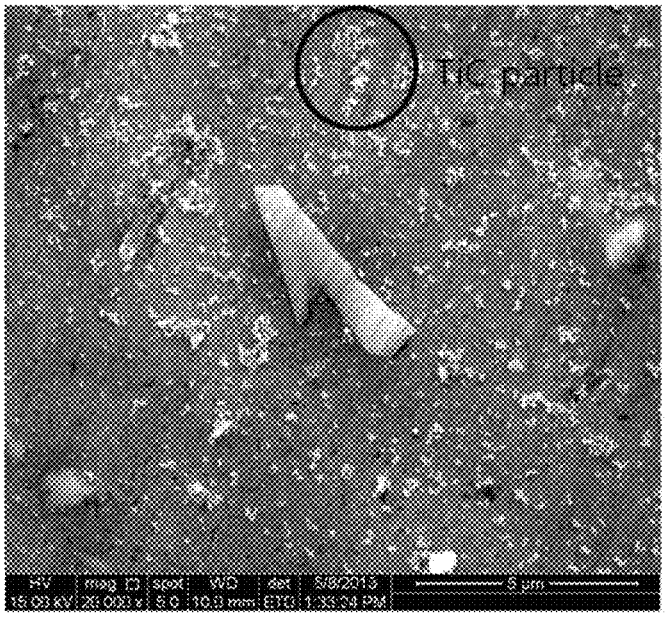
FIGS. 2A and 2B are photographic views showing TiC particles formed in an exemplary high-elasticity aluminum alloy according to an exemplary embodiment of the present invention.
Figure 2B:
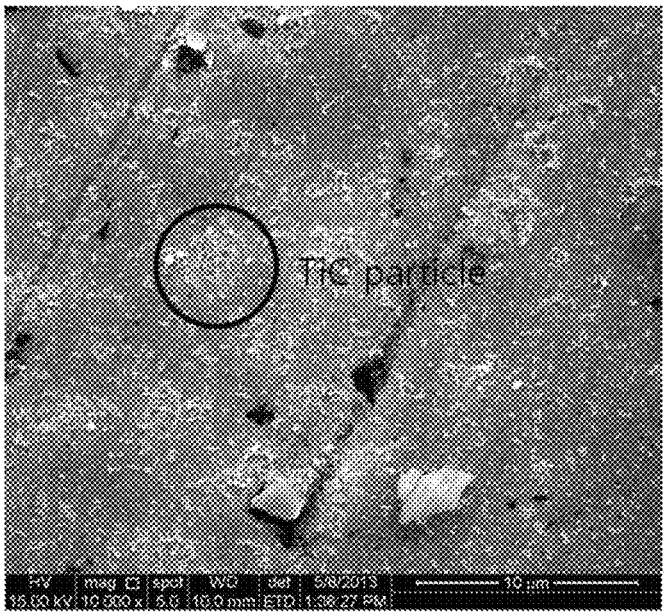

FIGS. 2A and 2B are a photographic views showing TiC particles formed in an exemplary high-elasticity aluminum alloy according to an exemplary embodiment of the present invention. As shown in FIGS. 2A and 2B, TiC particles in a size of about submicrometers are formed. Further, the TiC particles are not needle-shaped and are finer than to $Al_3Ti$ particles. As consequence, the elongation of the aluminum alloy may be improved.

In an exemplary embodiment, the high-elasticity aluminum alloy a may include: titanium (Ti); and boron (B). In particular, the aluminum alloy may include carbide in an internal tissue in the aluminum alloy, and a content of carbon in the carbide may be in a range of about 0.3 to 0.5 wt %.

In an exemplary embodiment, the carbide may be TiC or SiC. In certain embodiments, TiC or SiC may be in a form of particles. When the TiC particles are formed, the fraction of needle-shaped $Al_3Ti$ particles in the aluminum alloy may be reduced, and polygonal TiC particles may be formed. The formed TiC particles may have a particle size of submicrometers, and have excellent wettability to aluminum (Al), and thus the precipitation of TiC particles may be improved compared to that of $TiB_2$ particles.

In an exemplary embodiment, the content of carbon (C) added may be in an amount of about 0.3 to 0.5 wt %. In the aluminum alloy, carbon (C) may react with Ti or Si to form carbide. When the content of carbon (C) is less than about 0.3 wt %, carbide may not formed sufficiently, and thus the elongation of the aluminum alloy may not be improved. Further, when the content thereof is greater than 0.5 wt %, the formation of TiC may not increase, whereas the formation of SiC causing a negative influence on elongation may increase. Therefore, the content of carbon (C) may be in the above range.

In an exemplary embodiment, the aluminum alloy may include: titanium (Ti) in an amount of about 4 to 6 wt %, boron (B) in an amount of about 0.5 to 1.5 wt %, and silicon (Si) in an amount of about 10 to 12 w %.

Titanium (Ti), as used herein, may be an element for forming TiC. Although the content of Ti increases greater than about 6 wt %, the content of TiC in the aluminum alloy may not increase accordingly. Further, as the content of Ti decreases, Ti may form $TiB_2$ instead, and thus TiC may not be sufficiently formed. Therefore, the content of Ti may be in a range of about 4 to 6 wt %.

Boron (B), as used herein, may be an element for maintaining high-elasticity of the aluminum alloy. When the content of B is less than the predetermined amount of about 0.5 wt %, the elasticity of the aluminum alloy may not be improved by the addition of B. When content of B is greater than the predetermined amount of about 1.5 wt %, precipitation reinforcing phase may be substantially formed, and thus the elongation of the aluminum alloy may deteriorate. Therefore, the content of B may be in a range of about 0.5 to 1.5 wt %.

Silicon (Si), as used herein, may be an important element to improve the strength and castability of the aluminum alloy. When the content of Si is less than the predetermined amount of about 10 wt %, reinforcing effects and castability may not be obtained sufficiently. Further, when the content of Si is greater than the predetermined amount of about 12 wt %, coarse silicon particles may be formed, and thus the moldability and processability of the aluminum alloy may deteriorate. Therefore, the content of Si may be in a range of about 10 to 12 wt %.

In certain exemplary embodiments, the aluminum alloy may further include iron (Fe), copper (Cu), manganese (Mn), magnesium (Mg), nickel (Ni), zinc (Zn) or the like to improve various structural characteristics of the aluminum alloy, such as strength, elongation, fatigue, and corrosion resistance.

In another aspect, a method of manufacturing a high-elasticity aluminum alloy is provided.

In an exemplary embodiment, the method may include steps of: charging pure aluminum and an Al-5B master alloy into a melting furnace to form a first molten metal; charging an Al-10Ti master alloy in the first molten metal to form a second molten metal; charging silicon (Si) element in the second molten metal to form a third molten metal; adding carbon (C) to the third molten metal to form a fourth molten metal; and tapping the fourth molten metal into a mold to cast the fourth molten metal.

The first molten metal, as used herein, may be formed by charging pure aluminum and an Al-5B master alloy in a melting furnace. Typically, boron (B) may be added in the form of powder. Particularly, in an exemplary embodiment, the boron (B) may be added in the form of an Al-5B master alloy to form uniform $TiB_2$ particles. The first molten metal may be maintained at a temperature of about 800° C. for about 30 minutes.

The second molten metal, as used herein, may be formed by charging an Al-10Ti master alloy in the first molten metal. In an exemplary embodiment, the titanium (Ti) may be added in the form of an Al-10Ti master alloy to form a uniform precipitates. The second molten metal may be maintained at a temperature of about 800° C. for about 20 minutes.

The third molten metal, as used herein, may be formed by charging silicon (Si) element in the second molten metal. After silicon (Si) is charged, the third molten metal may be heated to a temperature of about 1000° C. and then maintained for about 30 minutes.

The fourth molten metal, as used herein, may be formed by adding carbon (C) to the third molten metal and carbide may be formed in the aluminum alloy. Particularly, the fraction of Al3Ti in the aluminum alloy may decrease by the formation of TiC, and thus the elongation of the aluminum alloy may be improved. In an exemplary embodiment, the carbon (C) may be added in an amount of about 0.3 to 0.5 wt %. Subsequently, the fourth molten metal may be maintained at a temperature of about 1000° C. for about 10 minutes.

In an exemplary embodiment, the fourth molten metal may be casted by tapping it into a mold.

Figure 3A:
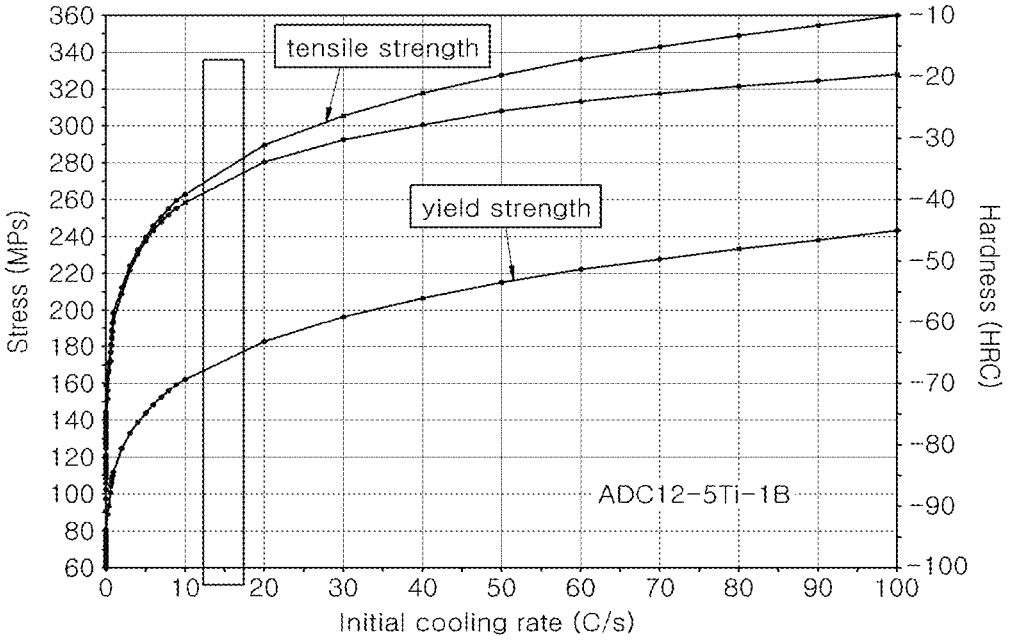
PRIOR ART FIG. 3A
FIGS. 3A-3C show photographic views showing the tensile strengths and yield strengths of an exemplary conventional ADC12-5Ti-1B alloy (FIG. 3A) and exemplary high-elasticity aluminum alloys according to exemplary embodiments of the present invention (FIGS. 3B-3C)
Figure 3B:
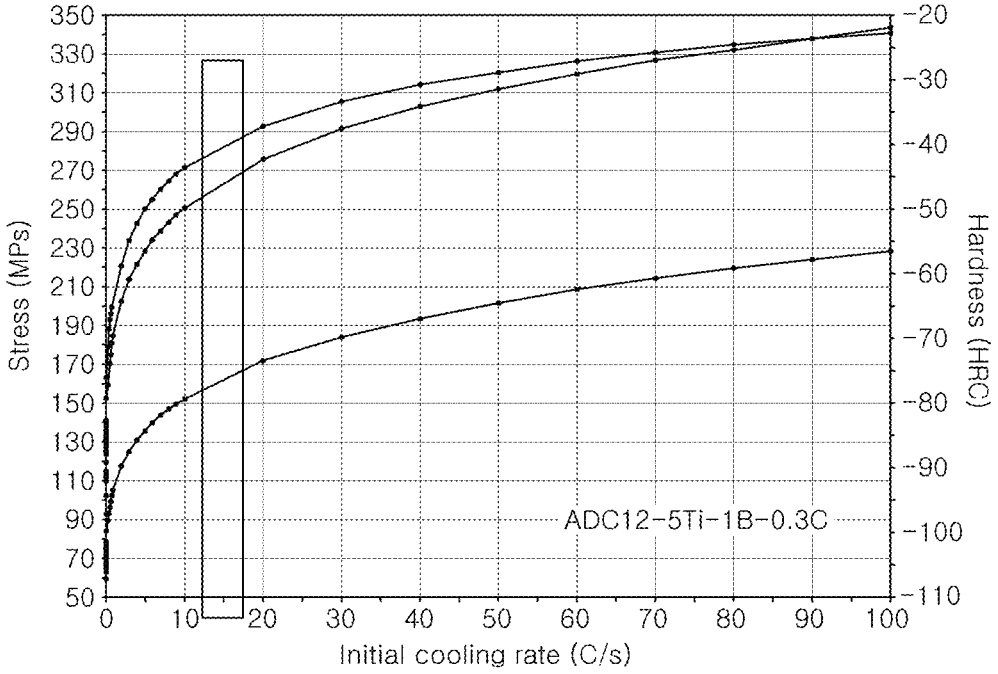
Figure 3C:
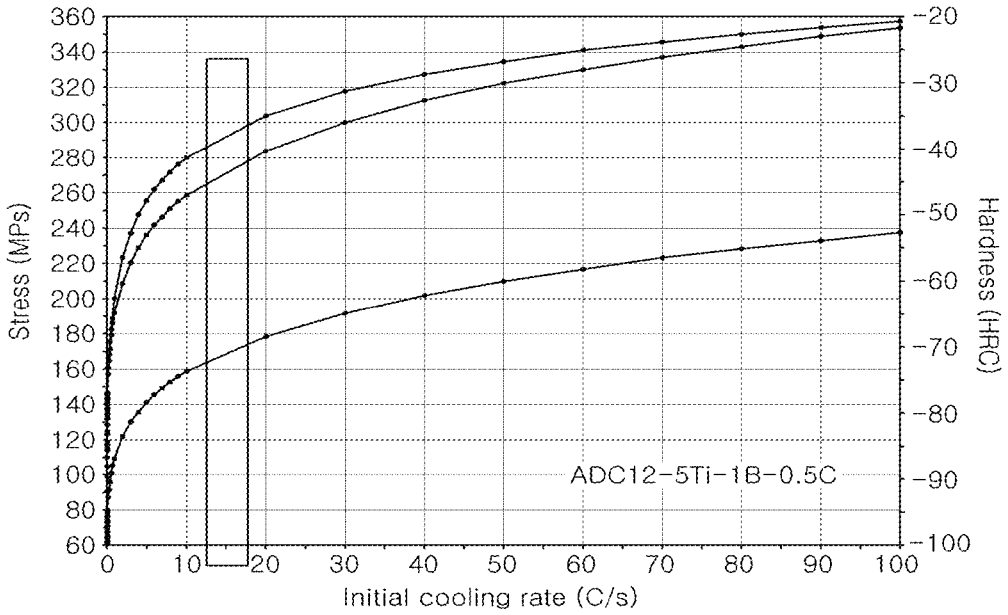
Figure 4A:
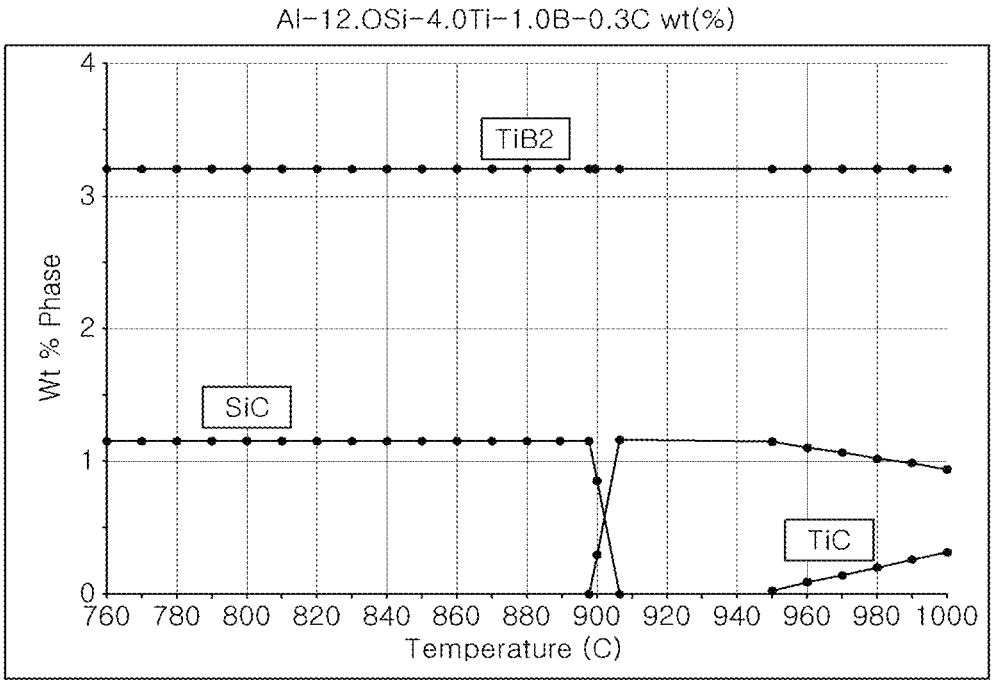
FIGS. 4A-4F show exemplary graphs showing changes in phase fractions of an exemplary high-elasticity aluminum alloy according to an exemplary embodiment of the present invention depending on contents of Ti and C.
Figure 4B:
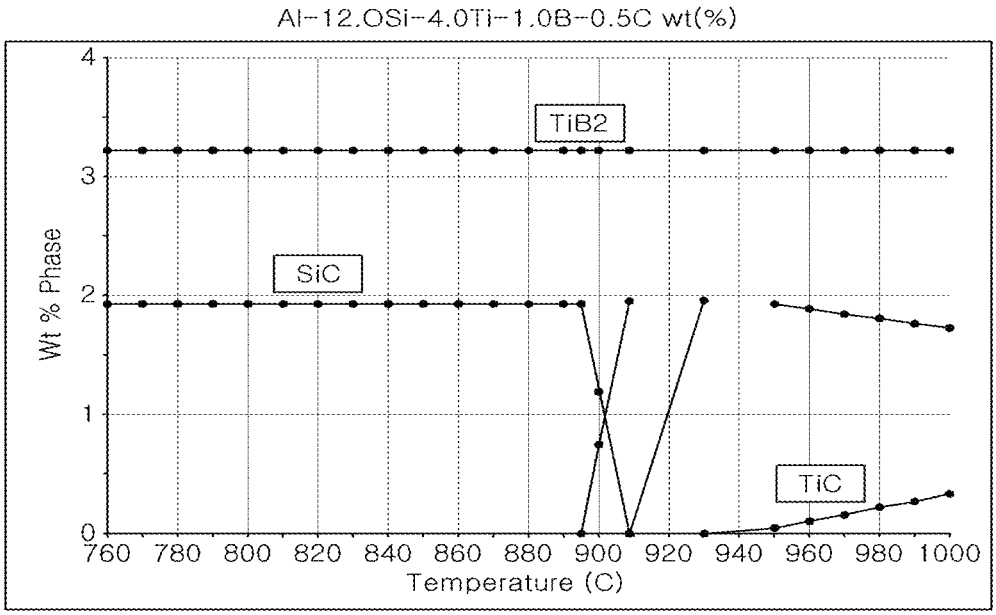
Figure 4C:
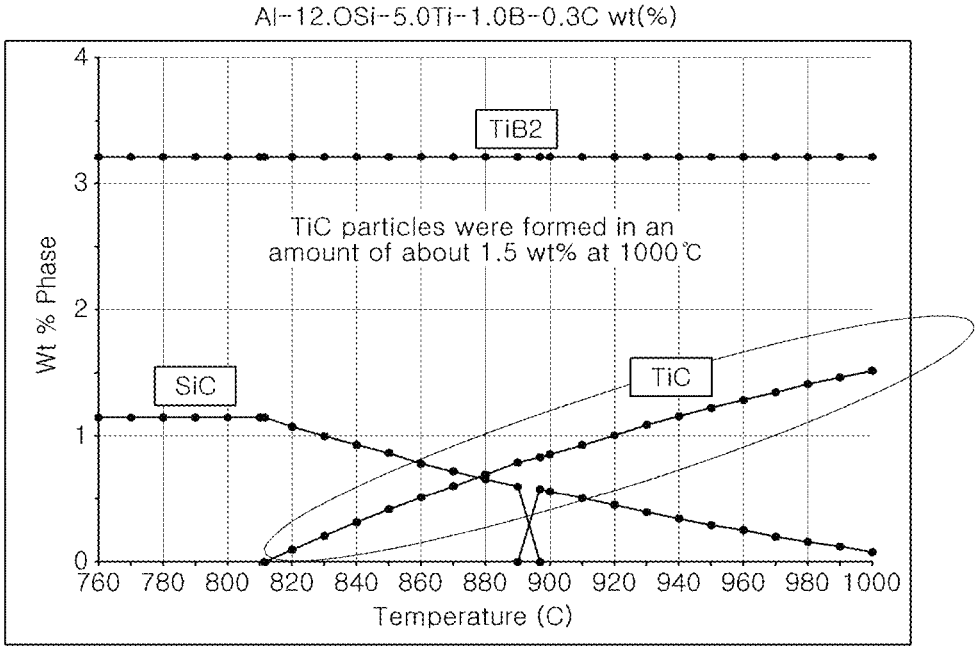
Figure 4D:
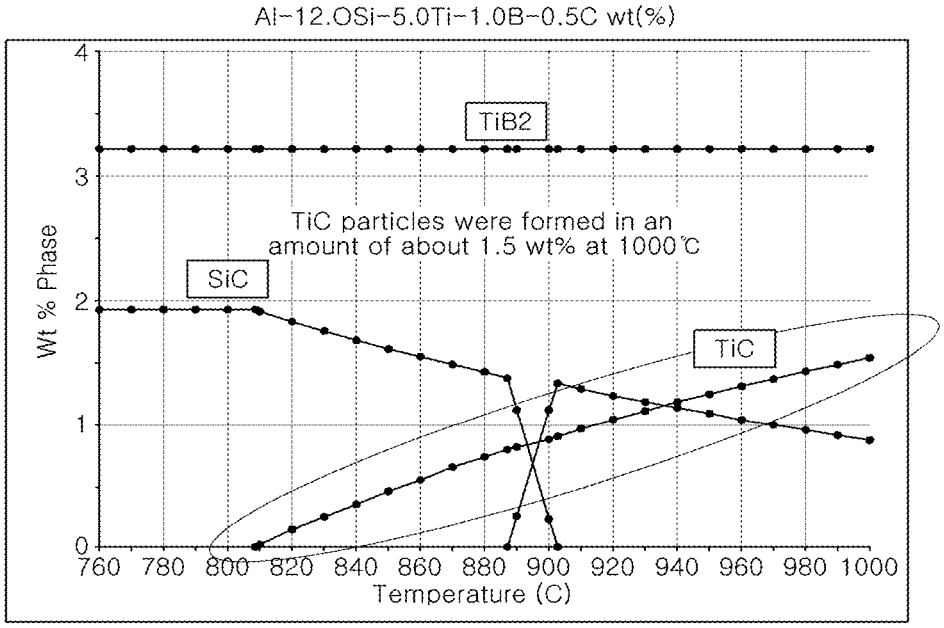
Figure 4E:
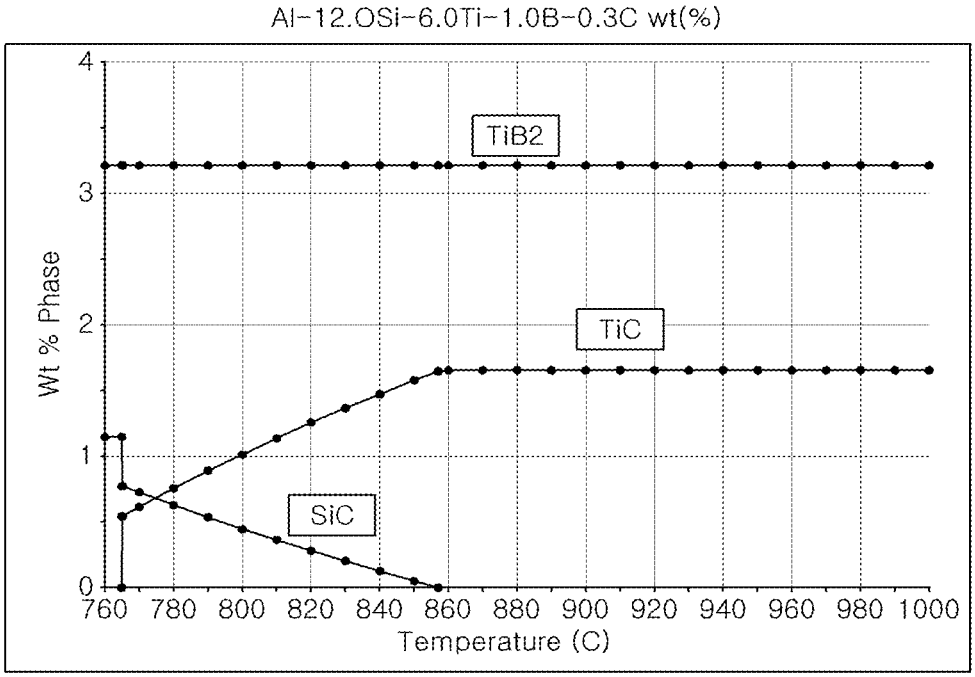
Figure 4F:
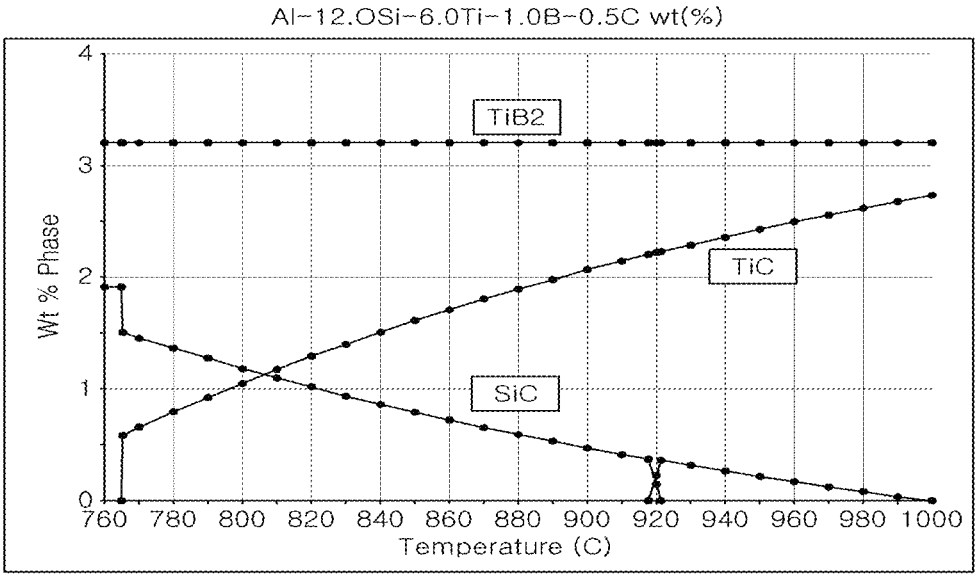
Figure 5A:
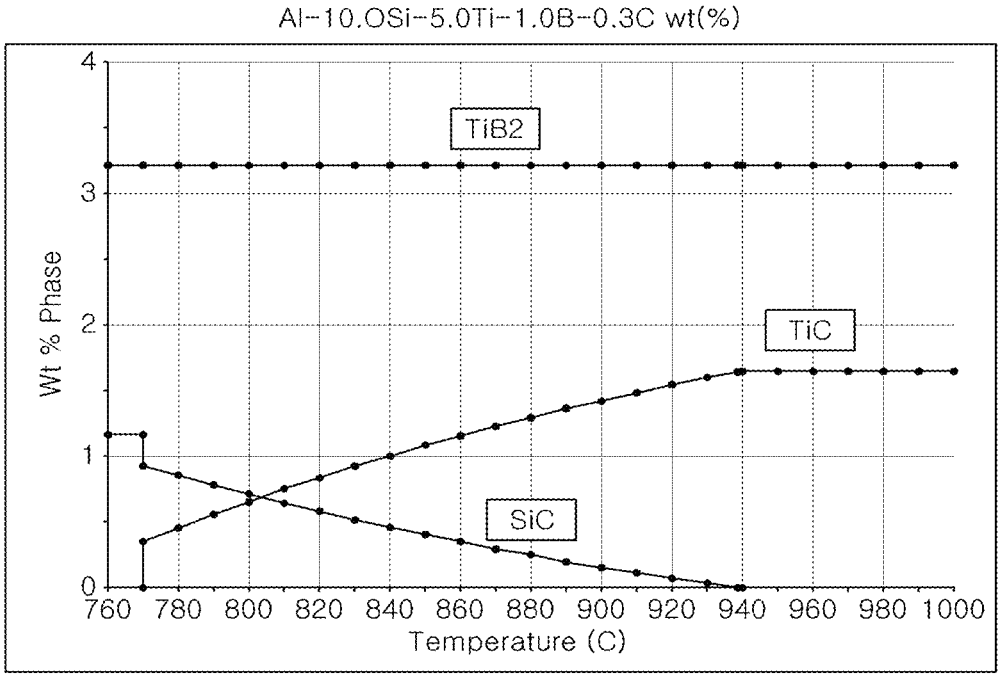
FIGS. 5A-5D show exemplary graphs showing changes in phase fractions of an exemplary high-elasticity aluminum alloy according to an exemplary embodiment of the present invention depending on contents of Ti and C.
Figure 5B:
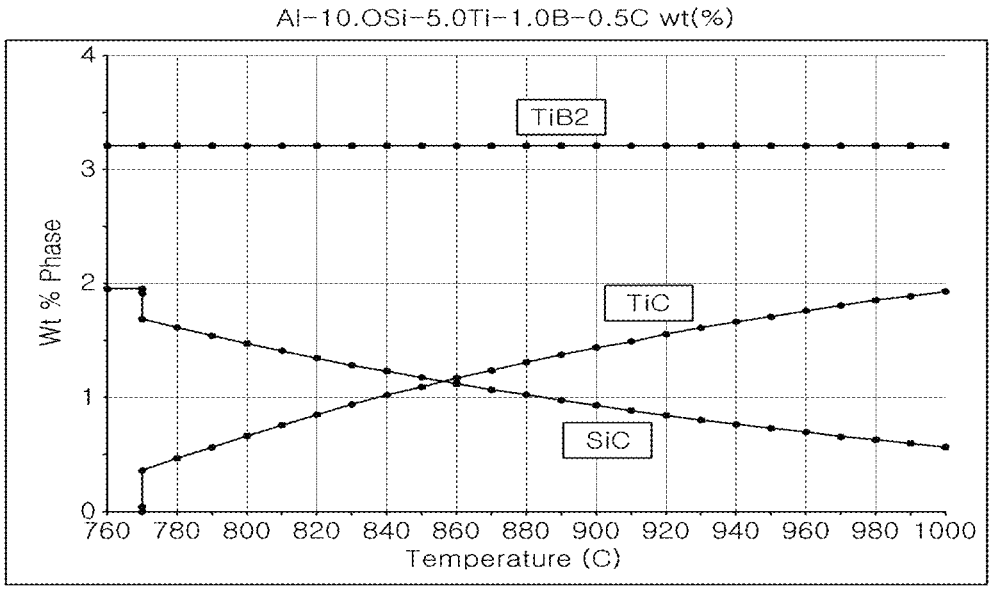
Figure 5C:
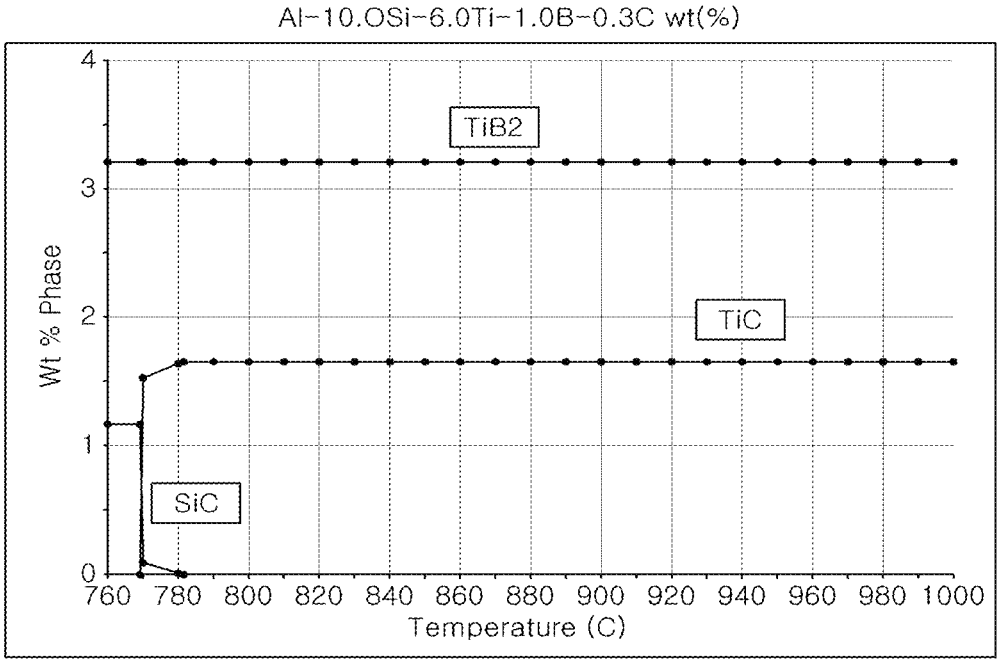
Figure 5D:
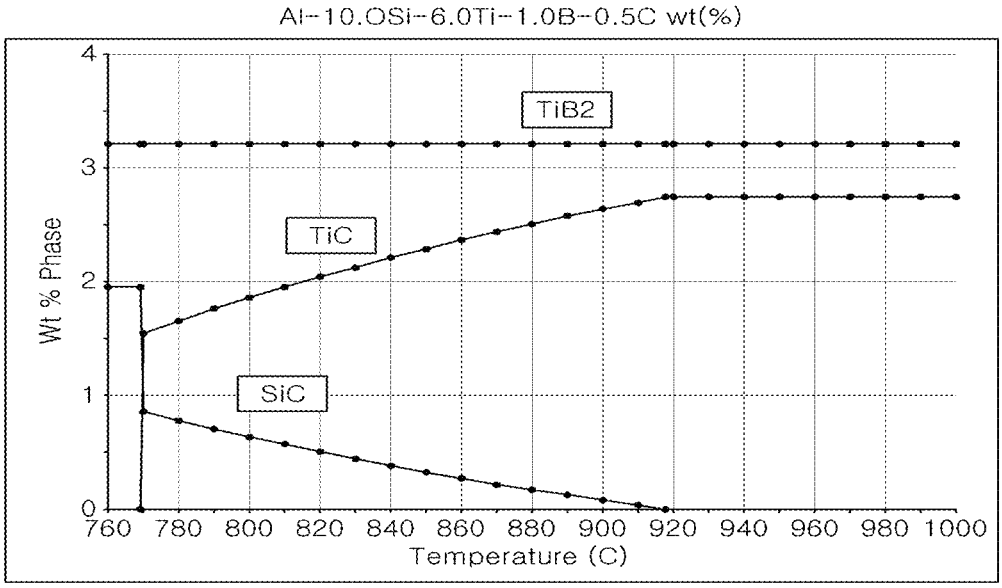

FIGS. 3A-3C show exemplary graphs comparing the tensile strength and yield strength of the aluminum alloy of the present invention to an exemplary conventional ADC12-5Ti-1B alloy. As shown in FIGS. 3A-3C, the elongation of the ADC12-5Ti-1B is about 0.5%, the elongation of the ADC12-5Ti-1B-0.3C is about 0.8% and the elongation of ADC12-5Ti-1B-0.5C is about 0.7%. Consequently, the elongation of the aluminum alloy according to exemplary embodiments of the present invention may be improved, and the tensile strength and yield strength thereof may be same without deterioration.

FIGS. 4A-4F show exemplary graphs showing changes in phase fractions depending on the contents of Ti and C of the high-elasticity aluminum alloy according to an exemplary embodiment of the present invention. As shown in FIGS. 4A-4F, the formation rate and formation temperature of TiC and SiC may change depending on the contents of Ti and C. As the content of Ti increases, the formation temperature of TiC may be lowered, whereas the formation rate thereof is about 1.5 wt %, which is same as the conventional aluminum alloy. In contrast, as the content of Ti decreases, Ti may form $TiB_2$, and thus the formation of TiC may be reduced, and the added carbon (C) may form SiC particles. Meanwhile, as the content of C increases, the formation rate of TiC, but the formation rate of SiC contributing to the reduction of elongation may also increases. Thus, the content of C may be less than about 0.5 wt %.

FIGS. 5A-5D show exemplary graphs showing changes in phase fractions depending on the contents of Ti and C of the high-elasticity aluminum alloy according to an exemplary embodiment of the present invention. Comparing the results of FIGS. 5A-5D to those of FIGS. 4A-4F, the change in the content of Si may provide greater influence on the formation rate of SiC than the content of TiC. When the content of Si decreases, the formation rate of TiC may not be substantially changed depending on the change in the content of Ti, while the formation rate of SiC decreases.

As described above, according to various exemplary embodiments of the present invention, by adding titanium (Ti) and boron (B) to the aluminum alloy, the high-elasticity aluminum alloy may be obtained and the elongation thereof may be improved by about 30% from the conventional casting aluminum alloy, while maintaining the strength therefrom. Therefore, when the high-elasticity aluminum alloy according to the present invention is used as a cast material for a vehicle, the strength and NVH of the cast material may be substantially improved from the conventional casting aluminum alloy, such as a commercially available ADC12-5Ti-1B product.

Although various exemplary embodiments of the present invention have been disclosed for illustrative purposes, it will be appreciated that the present invention is not limited thereto, and those skilled in the art will appreciate that various modifications, additions and substitutions are possible, without departing from the scope and spirit of the invention.

Accordingly, any and all modifications, variations or equivalent arrangements should be considered to be within the scope of the invention, and the detailed scope of the invention will be disclosed by the accompanying claims.

What is claimed is:

1. A method of manufacturing an aluminum alloy, comprising steps of:

charging pure aluminum and an Al-5B master alloy in a melting furnace to form a first molten metal;

charging an Al-10Ti master alloy in the first molten metal to form a second molten metal;

charging silicon (Si) element in the second molten metal to form a third molten metal;

adding carbon (C) to the third molten metal to form a fourth molten metal; and tapping the fourth molten metal into a mold to cast the fourth molten metal, wherein the aluminum alloy comprises titanium (Ti) in an amount of about 4 to 6 wt %; boron (B) in an amount of about 0.5 to 1.5 wt %; silicon (Si) in an amount of about 10 to 12 w %; carbon (C) in an amount of about 0.3 to about 0.5 wt %; a balance of aluminum; and inevitable impurities, wherein the aluminum alloy includes carbide in an internal tissue thereof, wherein the aluminum alloy includes $Al_3Ti$ less than the carbide on a basis of weight %.

* * * * *